US005833237A

United States Patent [19]

Velich

[11] Patent Number: 5,833,237

[45] Date of Patent: Nov. 10, 1998

[54] KINETIC DICE AND NUMBERED PLAYING CARDS

[76] Inventor: James F. Velich, 102 Grantham Ct., Walkersville, Md. 21793

[21] Appl. No.: 725,658

[22] Filed: Oct. 1, 1996

Related U.S. Application Data

[63] Continuation-in-part of Ser. No. 589,525, Jan. 22, 1996.

[51] Int. Cl.[6] ..... A63F 1/04; A63F 9/04

[52] U.S. Cl. ..... 273/146; 273/247; 273/296; 273/299; 273/304

[58] Field of Search ..... 273/146, 291, 273/288, 293, 296, 268, 247, 260, 299, 302, 304

[56] References Cited

U.S. PATENT DOCUMENTS

| | | | |
|---|---|---|---|
| 943,435 | 12/1909 | Maris | 273/288 |
| 1,528,061 | 3/1925 | Joyce | 273/296 |
| 3,791,648 | 2/1974 | Patterson | 273/291 |
| 3,913,919 | 10/1975 | Carpenter | 273/274 |
| 4,289,314 | 9/1981 | Berlino | 273/272 |
| 4,915,392 | 4/1990 | Swartz | 273/288 |
| 5,169,148 | 12/1992 | Wheeler | 273/146 |
| 5,505,462 | 4/1996 | Loewen | 273/146 |

*Primary Examiner*—Benjamin H. Layno
*Assistant Examiner*—Stephen L. Blau

[57] ABSTRACT

A game piece, or die, includes two flattened ends on either side thereof. Designated numbers, playing card symbols, and/or letters are marked or placed on the flattened ends to provide various game combinations. The die is dropped onto a hard, flat playing surface in an attempt to make the die stand on one of its flattened ends, thus showing the marking on the other flattened end. Target playing boards provide additional variations to games played with the playing piece. Die pieces with letters marked thereon are used in cryptographic-type games. Numbered playing cards and numbered letter cards using the same indicia or marking scheme as the die are also used as game pieces.

7 Claims, 13 Drawing Sheets

| Large Piece Chart | | Medium Piece Chart | | Small Piece Chart | |
|---|---|---|---|---|---|
| Top View | Bottom View | Top View | Bottom View | Top View | Bottom View |
| 6(red) | 1(black) | 6(red) | 1(black) | 6(black) | 1(red) |
| 6(black) | 1(red) | 6(black) | 1(red) | 6(red) | 1(black) |
| 5(red) | 2(black) | 5(red) | 2(black) | 5(black) | 2(red) |
| 5(black) | 2(red) | 5(black) | 2(red) | 5(red) | 2(black) |
| 4(red) | 3(black) | 4(black) | 3(red) | 4(black) | 3(red) |
| 4(black) | 3(red) | 4(red) | 3(black) | 4(red) | 3(black) |

FIG. 5

CARD SYMBOL AND NUMBER CHART

| HEARTS (RED) | | DIAMONDS (RED) | | CLUBS (BLACK) | | SPADES (BLACK) | |
|---|---|---|---|---|---|---|---|
| Card Symbol End | Number End | Card Symbol End | Number End | Card Symbol End | Number End | Card Symbol End | Number End |
| 2 ♡ | 1 | 2 ♢ | 2 | 2 ♧ | 3 | 2 ♤ | 4 |
| 3 ♡ | 2 | 3 ♢ | 3 | 3 ♧ | 4 | 3 ♤ | 5 |
| 4 ♡ | 3 | 4 ♢ | 4 | 4 ♧ | 5 | 4 ♤ | 6 |
| 5 ♡ | 4 | 5 ♢ | 5 | 5 ♧ | 6 | 5 ♤ | 1 |
| 6 ♡ | 5 | 6 ♢ | 6 | 6 ♧ | 1 | 6 ♤ | 2 |
| 7 ♡ | 6 | 7 ♢ | 1 | 7 ♧ | 2 | 7 ♤ | 3 |
| 8 ♡ | 1 | 8 ♢ | 2 | 8 ♧ | 3 | 8 ♤ | 4 |
| 9 ♡ | 2 | 9 ♢ | 3 | 9 ♧ | 4 | 9 ♤ | 5 |
| 10 ♡ | 3 | 10 ♢ | 4 | 10 ♧ | 5 | 10 ♤ | 6 |
| J ♡ | 4 | J ♢ | 5 | J ♧ | 6 | J ♤ | 1 |
| Q ♡ | 5 | Q ♢ | 6 | Q ♧ | 1 | Q ♤ | 2 |
| K ♡ | 6 | K ♢ | 1 | K ♧ | 2 | K ♤ | 3 |
| A ♡ | 1 | A ♢ | 2 | A ♧ | 3 | A ♤ | 4 |
| WC | 5 | | | WC | 6 | | |

FIG. 6A

CARD SYMBOL AND NUMBER CHART

| HEARTS (RED) | | DIAMONDS (RED) | | CLUBS (BLACK) | | SPADES (BLACK) | |
|---|---|---|---|---|---|---|---|
| Card Symbol End | Number End | Card Symbol End | Number End | Card Symbol End | Number End | Card Symbol End | Number End |
| 2 ♡ | 2 | 2 ♢ | 2 | 2 ♧ | 2 | 2 ♤ | 2 |
| 3 ♡ | 3 | 3 ♢ | 3 | 3 ♧ | 3 | 3 ♤ | 3 |
| 4 ♡ | 4 | 4 ♢ | 4 | 4 ♧ | 4 | 4 ♤ | 4 |
| 5 ♡ | 5 | 5 ♢ | 5 | 5 ♧ | 5 | 5 ♤ | 5 |
| 6 ♡ | 6 | 6 ♢ | 6 | 6 ♧ | 6 | 6 ♤ | 6 |
| 7 ♡ | 1 | 7 ♢ | 1 | 7 ♧ | 1 | 7 ♤ | 1 |
| 8 ♡ | 2 | 8 ♢ | 2 | 8 ♧ | 2 | 8 ♤ | 2 |
| 9 ♡ | 3 | 9 ♢ | 3 | 9 ♧ | 3 | 9 ♤ | 3 |
| 10 ♡ | 4 | 10 ♢ | 4 | 10 ♧ | 4 | 10 ♤ | 4 |
| J ♡ | 5 | J ♢ | 5 | J ♧ | 5 | J ♤ | 5 |
| Q ♡ | 6 | Q ♢ | 6 | Q ♧ | 6 | Q ♤ | 6 |
| K ♡ | 1 | K ♢ | 1 | K ♧ | 1 | K ♤ | 1 |
| A ♡ | 2 | A ♢ | 2 | A ♧ | 2 | A ♤ | 2 |
| WC | 3 | | | WC | 4 | | |

FIG. 6B

CARD SYMBOL AND NUMBER CHART

| HEARTS (RED) | | DIAMONDS (RED) | | CLUBS (BLACK) | | SPADES (BLACK) | |
|---|---|---|---|---|---|---|---|
| Card Symbol End | Number End | Card Symbol End | Number End | Card Symbol End | Number End | Card Symbol End | Number End |
| 2♡ | 2(wcc) | 2♢ | 2(y) | 2♧ | 2(r) | 2♤ | 2(p) |
| 3♡ | 3(w) | 3♢ | 3(wcc) | 3♧ | 3(m) | 3♤ | 3(k) |
| 4♡ | 4(s) | 4♢ | 4(v) | 4♧ | 4(wcc) | 4♤ | 4(s) |
| 5♡ | 5(r) | 5♢ | 5(m) | 5♧ | 5(s) | 5♤ | 5(t) |
| 6♡ | 6(a) | 6♢ | 6(e) | 6♧ | 6(o) | 6♤ | 6(wcv) |
| 7♡ | 1(e) | 7♢ | 1(a) | 7♧ | 1(wcv) | 7♤ | 1(v) |
| 8♡ | 2(l) | 8♢ | 2(d) | 8♧ | 2(g) | 8♤ | 2(s) |
| 9♡ | 3(z) | 9♢ | 3(b) | 9♧ | 3(l) | 9♤ | 3(s) |
| 10♡ | 4(v) | 10♢ | 4(f) | 10♧ | 4(t) | 10♤ | 4(n) |
| J♡ | 5(j) | J♢ | 5(q) | J♧ | 5(r) | J♤ | 5(d) |
| Q♡ | 6(i) | Q♢ | 6(i) | Q♧ | 6(v) | Q♤ | 6(a) |
| K♡ | 1(o) | K♢ | 1(e) | K♧ | 1(a) | K♤ | 1(e) |
| A♡ | 2(c) | A♢ | 2(t) | A♧ | 2(x) | A♤ | 2(wcc) |
| WC | 3(wcc) | | | WC | 4(wcc) | | |

FIG. 8

FIG. 9A
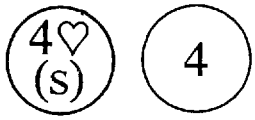
FIG. 9B
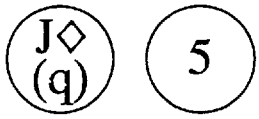
FIG. 9C
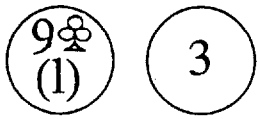
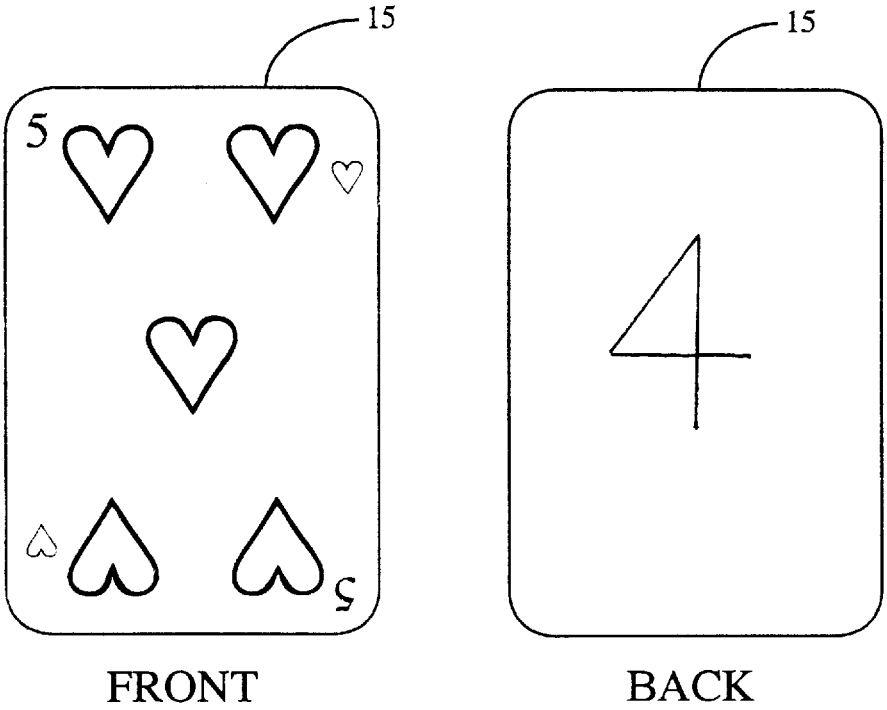
FIG. 11

KINETIC DICE AND NUMBERED PLAYING CARDS

This is a continuation-in-part of U.S. patent application Ser. No. 08/589,525, filed Jan. 22, 1996.

BACKGROUND OF THE INVENTION

The present invention relates to games using dice or playing cards, and in particular to unique playing pieces having two opposing sides each having indicia marked thereon and a method of using these unique playing pieces to play various games.

U.S. Pat. No. 5,505,462 to Loewen discloses a conical playing piece having two flattened ends and having indicia marked on a side surface of the playing piece. According to the patent, the conical playing piece is spun in the air in an attempt to cause the piece to land on one of its flattened ends.

However, this playing piece has the drawback that a player can see all of the indicia marked on the playing piece and there is little, if any, skill required in throwing the playing piece.

SUMMARY OF THE INVENTION

Dice, playing card and letter games have been very popular for a long time. However, there is continually a desire to improve these known games and to provide new games. It is therefore an object of the present invention to provide new and unique playing pieces and a method of use thereof for playing known games and for creating new games.

The playing piece according to the first embodiment of the present invention comprises a cylinder having a predetermined height and two flattened ends each having indicia marked thereon. The cylinder has a diameter of sufficient size such that the cylinder can freely stand on one of its flattened ends, and the cylinder is made of a material such that the cylinder will bounce off of a hard flat surface, when dropped, to a height sufficient such that the game piece can land on one of its flattened ends.

The indicia marked on the flattened ends can include numbers, letters, playing card symbols, other symbols or pictures, or combinations thereof.

The playing piece described above is referred to herein as a kinetic die piece. The kinetic die piece is used by holding it from about 1 to 3 inches above a playing surface (such as a desk or table), dropping the kinetic die piece on its side such that it bounces on the playing surface, and noting, if the kinetic die piece lands on one of its flattened ends, the indicia marked on the upwardly exposed flattened end.

The kinetic die of the present invention challenges players to bounce the die on its side surface and make the die stand on one of its flattened ends. Further, due to the varied indicia, both simple and complex games can be played. The kinetic dice can also be used as a measuring tool for testing persons having physiological or physical problems, e.g. steadiness of hand.

Thus, the kinetic die piece of the present invention overcomes the drawback of the Loewen '562 patent. In particular, because the kinetic die piece of the present invention has indicia marked on the flattened ends thereof, players can only see the indicia marked on an exposed flattened end while the unexposed flattened end is hidden from view. Such an arrangement enables players to play many more and different games than those that can be played with the playing piece according to the prior art.

Furthermore, the kinetic die piece of the present invention has a substantially cylindrical body having a side surface between the flattened ends, this side surface being bounced off of a playing surface to induce a landing on one of the flattened ends. Thus, the act of throwing the playing piece introduces a certain level of skill to the game.

It is a further object of the present invention to provide a game board having targets thereon onto which the kinetic die piece can be dropped and noting whether the kinetic die piece lands on one of its flattened ends within one of the targets.

It is still a further object to provide specially designed playing cards having the same indicia scheme as the kinetic die pieces as a second embodiment of the present invention.

BRIEF DESCRIPTION OF THE DRAWINGS

The above and other objects of the present invention will be readily understood from the following description, when taken with reference to the corresponding drawings.

FIG. 5 depicts a chart showing exemplary indicia marked on the flattened ends of each kinetic die piece for kinetic number dice.

FIGS. 6*a–b* depict alternate charts showing the card symbol and number associated with each kinetic die piece for kinetic card dice.

FIG. 8 depicts a chart showing indicia marked on each kinetic die piece for the combination of kinetic card dice and kinetic letter dice.

FIGS. 9*a–c* show examples of kinetic card letter dice.

FIG. 11 shows an example of a numbered playing card.

DETAILED DESCRIPTION OF THE PREFERRED EMBODIMENTS

The present invention involves game pieces having particular indicia marked thereon. A first embodiment of the invention is explained with reference to FIGS. 1–10 and a second embodiment of the invention is explained with reference to FIGS. 11–13.

Figure 1:
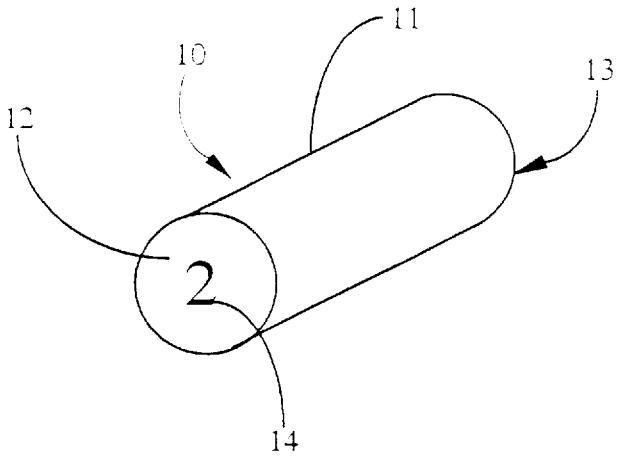
FIG. 1 shows a perspective view of a kinetic die piece according to the present invention.

The basic structure of the playing piece of the first embodiment of the invention is shown by reference numeral 10 in FIG. 1. FIG. 1 shows a substantially cylindrical playing piece 10 having a side surface 11 and two flattened ends 12, 13. The flattened ends 12, 13, each have indicia 14 marked thereon. In FIG. 1, flattened end 12 includes the number 2 as the indicia 14. Flattened end 13 also has a particular indicia or marking 14, but is out of view in the perspective view of the figure.

Any method can be used to form indicia 14 on flattened ends 12, 13. The indicia 14 can be, for example, printed, etched or painted, on flattened ends 12, 13. The indicia 14 can also be placed on stickers, which are themselves then adhered to the flattened ends 12, 13. Furthermore, numbers can be spelled out rather than using their roman numeral representation.

The playing piece 10 of FIG. 1 is referred to generally hereinafter as a kinetic die or kinetic die piece. The kinetic dice can be made from any suitable game-piece material. Each kinetic die 10 is preferably made from wood or solid plastic, e.g. nylon plastic. The diameter of each kinetic die 10 for all games described hereinafter is preferably ⅝ inch. While other diameters of the kinetic die 10 may function adequately, the ⅝ inch diameter appears to function optimally for game purposes.

Figure 2A:
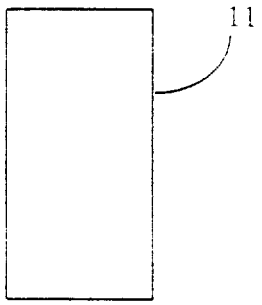
FIGS. 2*a–b* show front and top and bottom views of the kinetic die piece.
Figure 2B:
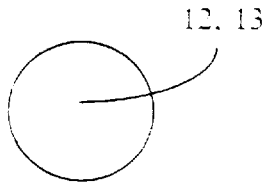

FIG. 2*a* shows a side view and FIG. 2*b* shows both top and bottom views of the kinetic die piece 10.

Figure 3A:
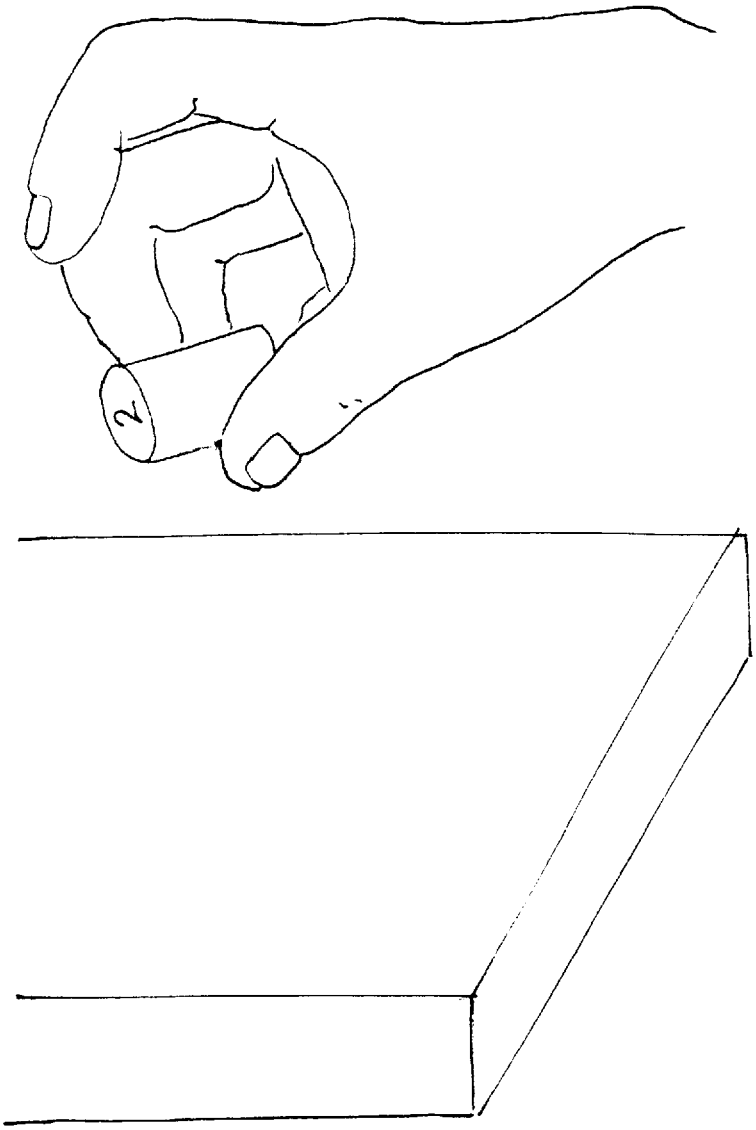
FIGS. 3*a–d* show a suggested method of holding and dropping the kinetic dice piece and show successful and unsuccessful attempts at creating a sitter.
Figure 3B:
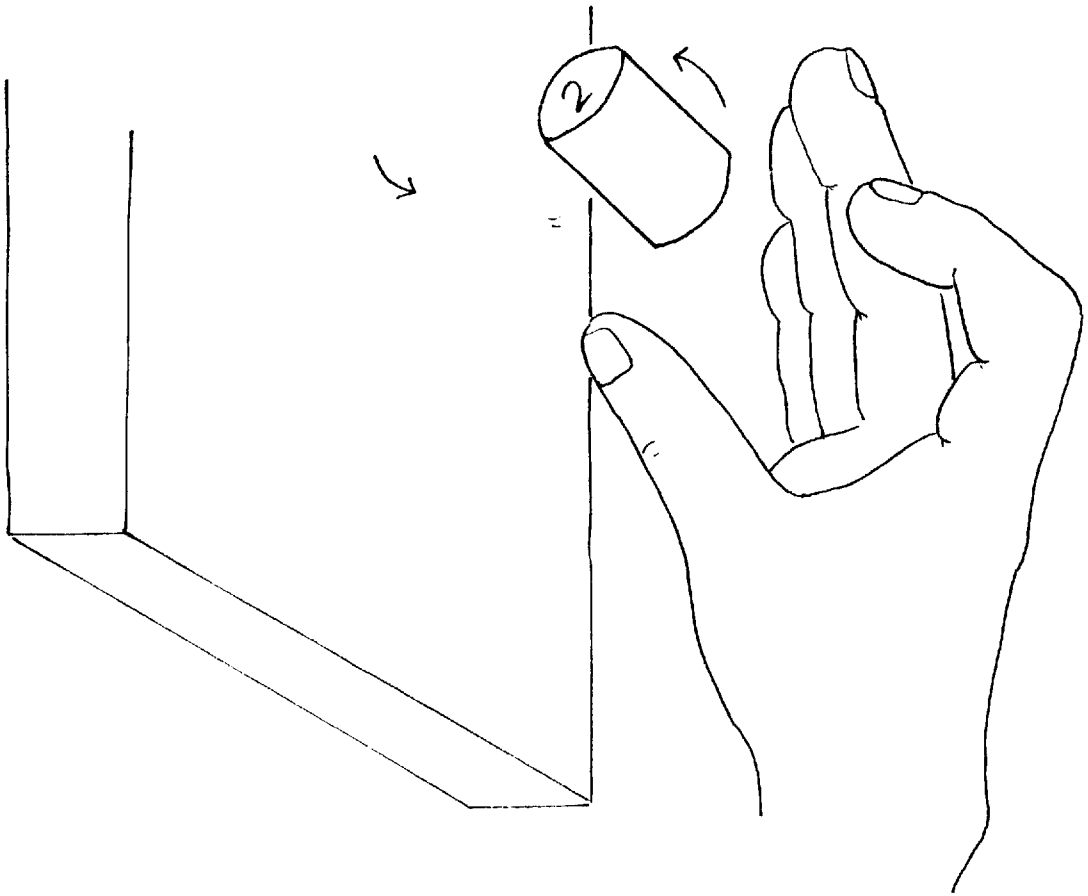
Figure 3C:
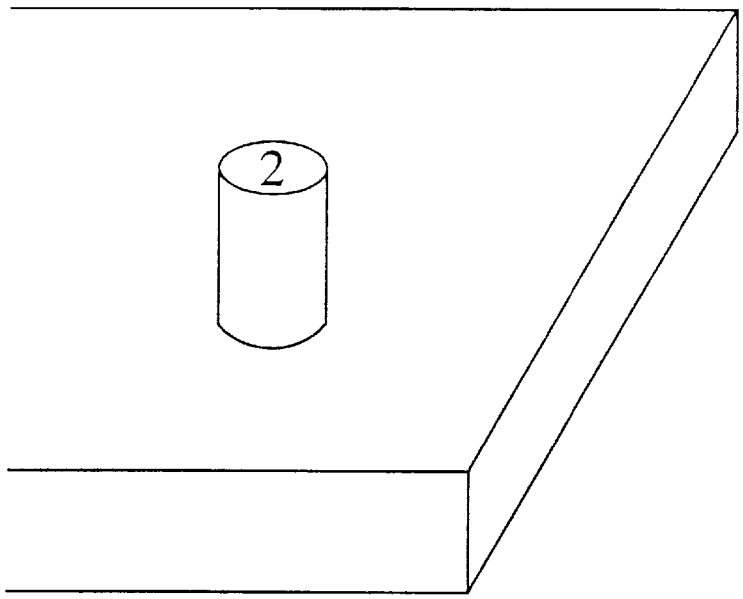
Figure 3D:
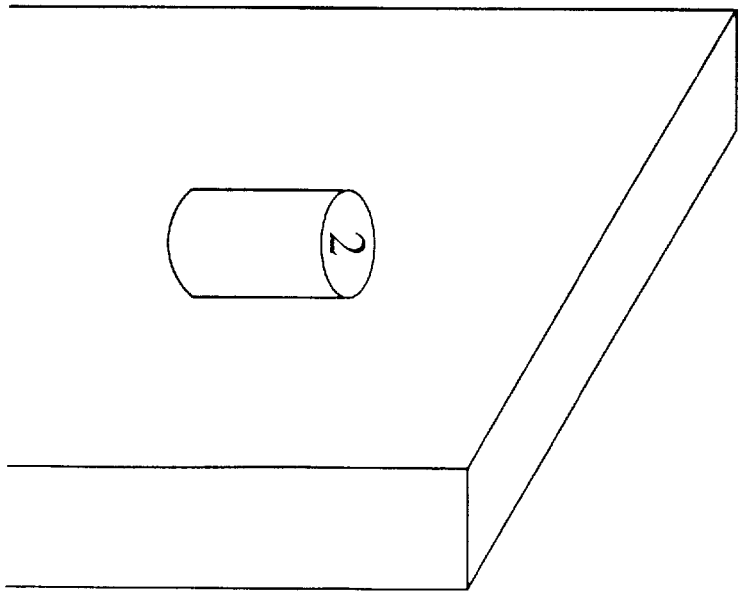

With reference to FIG. 3*a*, the kinetic die 10 is used by holding side surface 11, perpendicular to the flattened ends 12, 13, parallel to a designated hard, flat, playing surface and dropping the kinetic die 10 onto the surface thereby resulting in a bouncing motion as shown in FIG. 3*b*. When the kinetic die 10 comes to rest, it will either be standing on one of its flattened ends 12 or 13 as shown in FIG. 3*c* or will be lying on side surface 11 extending between the flattened ends 12, 13 as shown in FIG. 3*d*. A successful attempt at making the kinetic die 10 stand on one of its flattened ends, as shown in FIG. 3*c*, is referred to hereinafter as creating a sitter. Ideally, to create a sitter, the kinetic die 10 is held one to three inches above the playing surface and then bounced on its side surface 11 against the playing surface. Of course, a certain degree of skill/practice is necessary to bounce the die and have it land on one of its flattened ends.

When a sitter is created, a designated marking, or indicia 14, is viewed on the upwardly exposed flattened end 12 or 13 of the kinetic die 10. This marking is, depending on the game being played, either a number, letter, playing card symbol, other symbol or combination thereof, as will be explained below.

Variations of the kinetic die 10 including the indicia 14 that are marked on the flattened ends 12, 13 and various games using the kinetic die 10 are explained next.

KINETIC NUMBER DICE

Figure 4A:
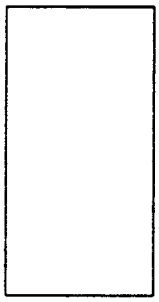
FIGS. 4*a–c* show the relative size of the kinetic die pieces for kinetic number dice.
Figure 4B:
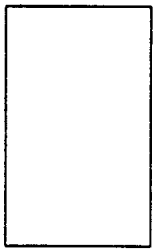
Figure 4C:
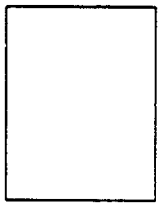

Kinetic number dice is a game, which uses the aforementioned kinetic die 10. In this game, three kinetic die pieces 10 having different lengths are used. It is noted, however, that the lengths of the kinetic die pieces 10 can be the same as well. FIGS. 4*a–c* show the relative size of each of the three kinetic die pieces 10 used for this game. Preferably, the largest kinetic die 10 is 1 and ¼ inch long, the middle sized kinetic die 10 is 1 inch long and the smallest kinetic die 10 is ¾ inch long.

The indicia 14 for kinetic number dice are designed to resemble, as close as possible, a standard playing die having six numbers. The indicia 14 scheme is arranged to have the number pairs 6 and 1, 5 and 2, and 4 and 3 on opposite sides of each respective kinetic die piece 10.

FIG. 5 shows a chart of the markings, or indicia 14 for a set of 18 kinetic number dice. From the chart of FIG. 5 it can be seen that all three kinetic die 10 sizes include the number 6 on one flattened end 12 or 13 and a number 1 on its opposite flattened end 12 or 13. Likewise, all sizes include two pairs of the numbers 5 and 2, and two pairs of the numbers 4 and 3.

To distinguish between two kinetic die pieces 10 having the same pairs of numbers, i.e. indicia 14, marked thereon, each indicia 14 is marked in a particular color, red or black, as shown in the chart of FIG. 5. For example, with the two large kinetic die pieces 10 showing a 6 and a 1, the 6 on one flattened end, 12 or 13, of the kinetic die 10 is black and the 1 on the opposite side is colored red. These color variations provide additional game variations.

One objective of a game that can be played with the above-described kinetic number dice is to create six numbers in a row of the same color. In this game, a player must not only create a sitter, but must also create a sitter showing the correct color side of the kinetic die 10.

For some games, the color on the kinetic die may not matter. For example, a game can comprise throwing a standard die and then trying to duplicate the "roll" with a kinetic die 10.

Other games that can be played with kinetic number dice include attempting to achieve a higher score than an opponent, attempting to create a "straight" by creating sitters showing the numbers from 1 to 6, and trying to copy a number value of a sitter created by an opponent.

As is understood by those skilled in the art, many new and old games can be played using the above-described kinetic number dice.

KINETIC CARD DICE

In kinetic card dice, kinetic die pieces 10 of only one length are used, preferably 1 inch long. This game is based on the fifty two cards found in a standard deck of playing cards. Two additional kinetic die pieces 10 are included and represent jokers or wild cards.

FIGS. 6*a–b* show two alternatives, respectively, of the indicia 14 marked on the flattened ends 12, 13 of each kinetic die piece 10 in kinetic card dice. As depicted in the charts, the indicia 14 marked on one side of the kinetic die piece 10 is the number and suit for a particular playing card and on the opposite flattened end, a number 1–6 is marked. Furthermore, the color of the number from 1–6 corresponds to the color of the suit on the opposite flattened end 12 or 13. Thus, the number from 1 to 6 is red for heart and diamond suit kinetic die pieces 10 and black for club and spade suit kinetic die pieces 10. There is also a red number associated with one of two wild cards, and a black number associated with the other wild card. The difference between the charts of FIGS. 6*a* and 6*b* is the number 1–6 associated with each suit/number indicia 14.

An advantage of kinetic card dice over traditional playing cards is that the element of creating sitters, as explained with respect to kinetic number dice above, can now become part of traditional card games. Moreover, since each kinetic card die piece 10 always has the same number associated with it, and since the numbers only go up to six, one particular number with its associated color can only be any one of four or five kinetic card die pieces 10.

Accordingly, kinetic card dice games can be specifically designed with the number aspect in mind. To modify the poker game of five card draw, for example, each player is dealt five kinetic card dice pieces 10 with only the flattened end with the number 1–6 showing. Thus, the more a player plays, the more accurately he can establish what "cards" are being held by the other players simply by noting which numbers are showing. He can then decide whether to trade up to three or four pieces (according to the traditional rules for draw poker) to obtain the best hand possible. Kinetic die pieces 10 discarded are turned over, thus showing what "cards" were discarded.

Therefore, with kinetic card dice according to the present invention, each player can effectively narrow down the possibilities of what other players may have in their respective final hands. The above-described method of playing five card draw with the kinetic card dice can be further modified by incorporating the requirement of creating sitters to improve one's hand. The possible game variations of standard card games as well as the creation of new games is almost unlimited.

It is also noted that kinetic card die pieces 10 may have playing card symbols marked on both sides of each piece instead of having numbers on one of the flattened ends 12, 13.

Kinetic Letter Dice

Figure 7:
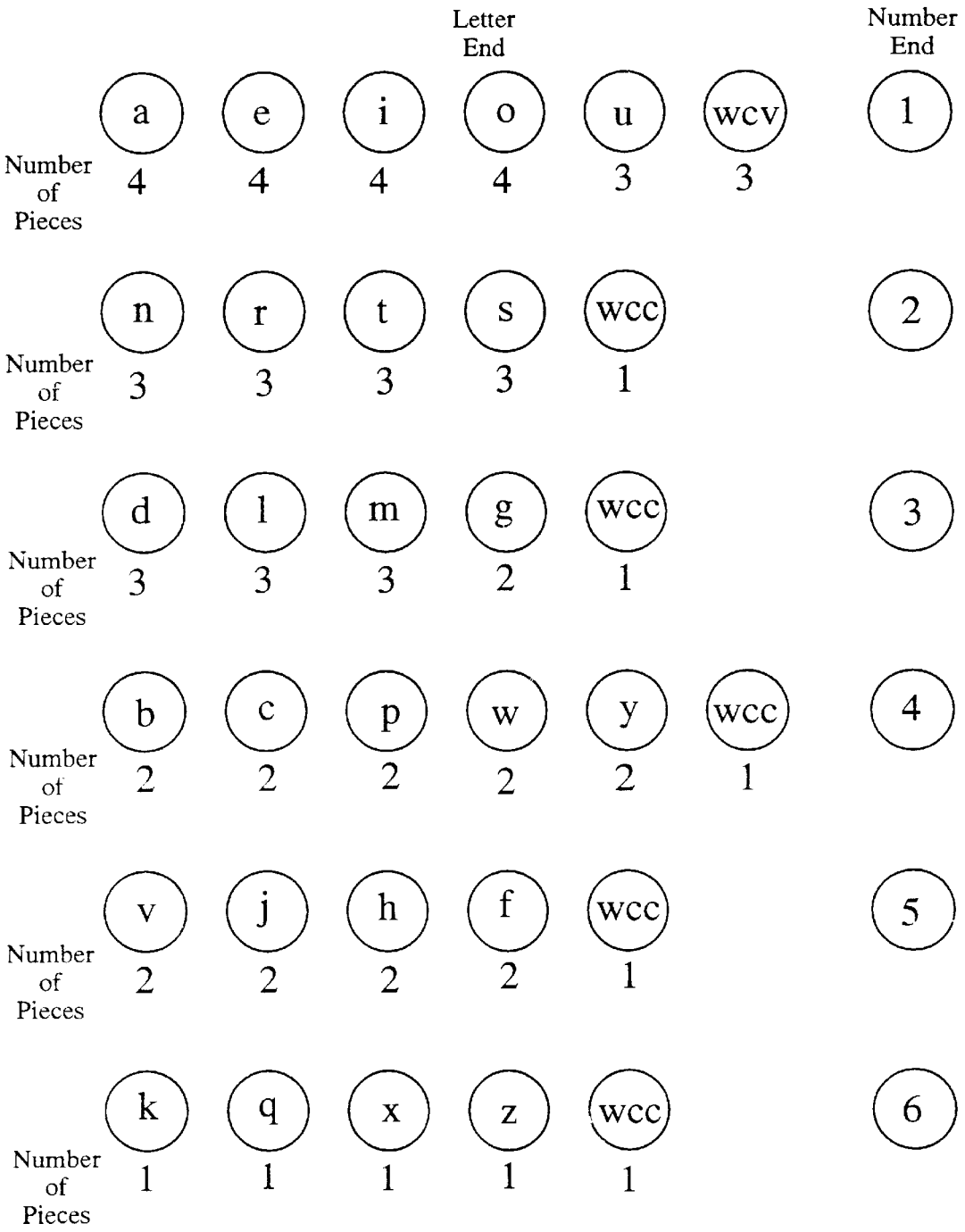
FIG. 7 depicts a chart showing the letter or wild card symbol, and associated number with that letter or wild card symbol, for each kinetic die piece in kinetic letter dice.

Kinetic letter die pieces 10 are similar to kinetic card die pieces in that each has a number from 1 to 6 on one of its flattened ends 12 or 13. In this game, however, the indicia 14 marked on the other flattened end are letters of the alphabet. The numbers 1–6 are used so that games can be played that incorporate standard 6-sided dice. A chart depicting the letter-number combinations for kinetic letter dice is shown in FIG. 7.

Each kinetic die piece 10 in kinetic letter dice is preferably ⅝ inch in diameter and 1 inch in length, like the kinetic card dice explained above. Kinetic letter dice comprise 72 kinetic die pieces 10.

In kinetic letter dice, each of the twenty-six letters of the alphabet has at least one corresponding kinetic die piece 10, but usually more. There are also two additional type of pieces. An indicia 14 of "WCV" stands for "wild card vowel" and can be substituted for any other vowel. The marking 14 on the number side of the WCV pieces is a red 1, thereby designating it a vowel. An indicia 14 of "WCC" stands for "wild card consonant" and can be substituted for any consonant. The marking on the number side of the WCC piece shows a black number from 2 to 6, thereby designating a consonant.

The number of kinetic letter die pieces 10 for each letter in a set of kinetic letter dice depends on the respective apparent frequency of use of the letter, for example, in the English language. Thus, with reference to FIG. 7, frequently used consonants have a 2 marked on the opposite side of the letter indicia 14 and the remaining consonants are marked according to their respective apparent frequency of use from 3–6.

The numbering system for the indicia 14 on one of the flattened ends 12, 13 is similar to both kinetic number dice and kinetic card dice. That is, the number on each kinetic letter die piece 10 ranges from 1 to 6 to permit incorporation of a standard die into games played with the kinetic letter dice. The difference with respect to the coloring scheme between kinetic letter dice and the other two previously described games pieces is that, although the color of the numbers is still red or black, the color in kinetic letter dice distinguishes only between vowels and consonants. That is, all vowels have a red number 1 on the flattened end 12 or 13 opposite the flattened end 12 or 13 of the letter indicia 14.

Like the previously described games, kinetic letter dice can be used in games that rely on the creation of sitters. Significantly, the number indicia 14 on kinetic letter dice can be used in cryptographic type games, with or without the element of creating sitters as part of the main strategy of the game.

The following is an example of a cryptographic-type game. One player forms a word using the game pieces while exposing only the numbered end of the game pieces. A standard die is then rolled by an opponent and the kinetic die corresponding to the roll of the standard die is turned over to help the opponent decipher the word.

Another example of a cryptographic-type game is players each receive a predetermined number of kinetic die pieces with only the numbered ends exposed. The object of the game is to be the first player to create a word or phrase with their game pieces. If no words or phrases can be created, players then successively exchange their game pieces one at a time until a player can create a word or phrase.

A variation of the kinetic letter dice includes having a letter on both flattened ends 12, 13 of each kinetic die piece 10 instead of a number on one flattened end and a letter indicia on the other.

Kinetic card—letter dice

It is possible to combine the elements of both the kinetic card dice and kinetic letter dice into one game with one set of kinetic die pieces 10. Since the pieces of both games are of the same dimension, the combination is simplified. The number of game pieces, however, is reduced to fifty four pieces in order to make the consolidation possible in view of the number of playing cards.

On the flattened end 12 or 13 whereon the playing card indicia 14 is marked, a letter is also marked inside or next to the suit symbol for that particular piece. Thus, each card symbol has a unique letter associated with it. This includes those pieces designated as a Wild Card Vowel (WCV) or Wild Card Consonant (WCC).

While there is still a number from 1–6 on the opposite flattened end 12 or 13, the red and black color is only important, in this case, for the card aspect of the game. That is, the color of the number corresponds only to the card suit color. Furthermore, while the number indicia 14 of 1 still represents a vowel, the color for this number may be red or black. FIG. 8 shows a chart depicting the indicia 14 for kinetic card-letter dice.

All games that can be played with either kinetic card dice or kinetic letter dice can be played with this combined type of dice.

FIGS. 9*a–c* show examples of the indicia 14 marked on opposite sides of a playing piece 10 in accordance with the chart of FIG. 8.

Target Games

Figure 10:
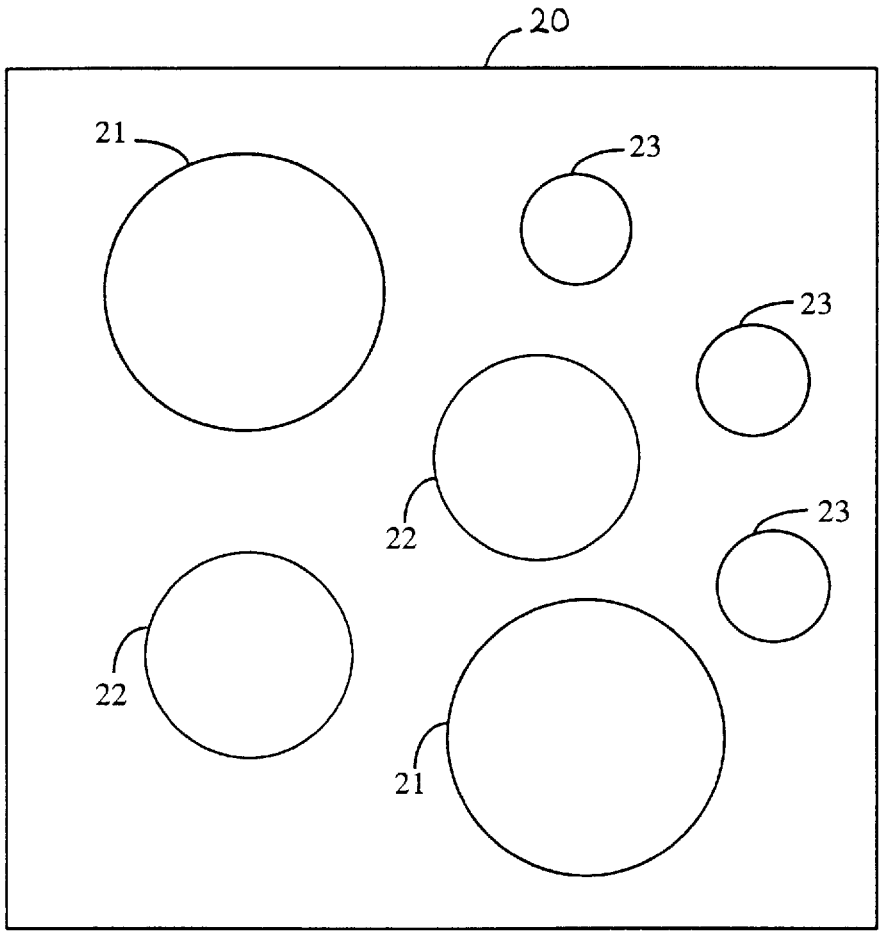
FIG. 10 shows an exemplary game board used with kinetic die pieces.

FIG. 10 shows a game board 20 having a plurality of circles or targets 21, 22, 23. The targets 21–23 can have the same diameter as shown in the figure or can vary in size. Furthermore, the targets can be squares, circles or any other geometric shape. The targets may also be assigned predetermined point values if desired. Such a game board 20 can be incorporated into any of the aforementioned kinetic dice games by, for example, requiring that a sitter be created within one of the targets. Game board 20 thus adds yet another element to the above described games.

The game board 20 itself need not be of any particular dimension, but must be sufficiently rigid to enable the creation of sitters. On the other hand, the board 20 can be printed on a thin sheet of paper or plastic and laid over a hard flat surface. Such a board 20 is more inexpensive than a rigid one.

One possible game board is a standard chess board wherein each square thereon is assigned a particular point value. To further enhance this game board, circles or other geometric shape are marked within each square thereby providing an opportunity to obtain a bull's eye within any individual square.

The second embodiment of the invention is explained with reference to FIGS. 11–13. Instead of kinetic die pieces 10, the second embodiment of the present invention arranges the various pairs of indicia 14 on playing cards. Thus, creating sitters is no longer an objective in games according to the second embodiment.

Numbered playing cards

With reference first to FIG. 11, a playing card 15 is shown with a five of hearts marked on the front thereof. On the back of the same playing card 15 the number 4 is marked in accordance with the chart of FIG. 6*a*. The color of the number is also in accordance with the chart of FIG. 6*a*. Such a marking differs from traditional playing cards which typically have the same design on the back of each card. The same types of games that can be played with kinetic card dice can be played with the numbered playing cards of the second embodiment.

Numbered letter cards

Figure 12:
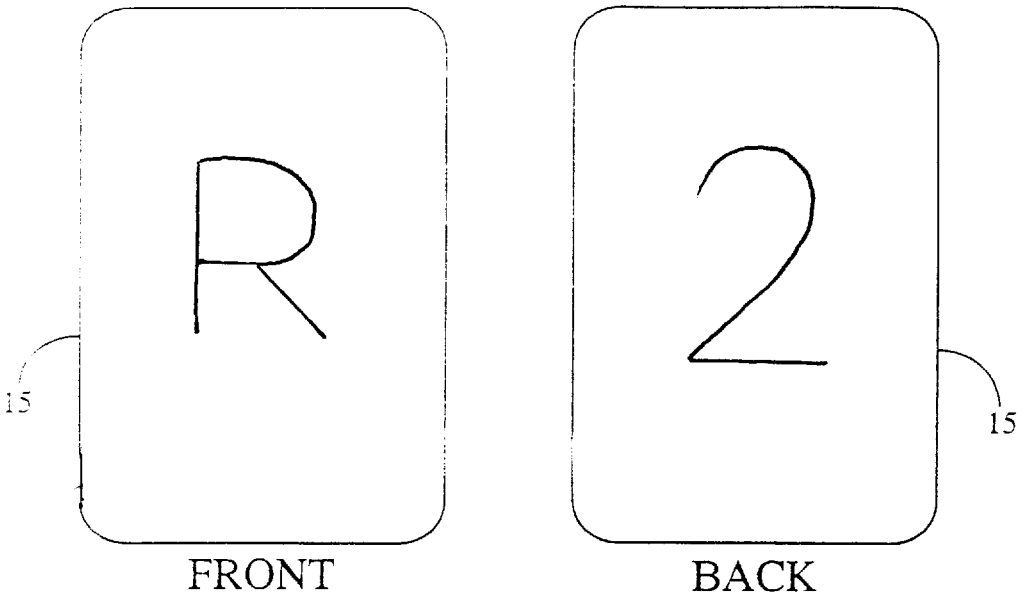
FIG. 12 shows an example of a numbered letter card.
Figure 13:
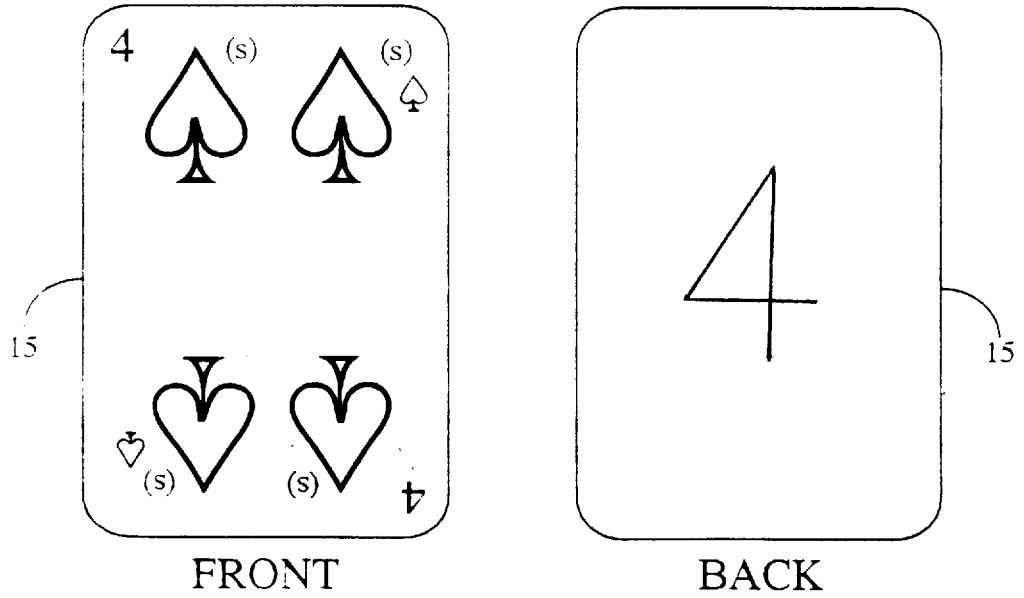
FIG. 13 shows an example of a combination number-letter playing card.

FIG. 12 shows a playing card 15 having a letter marked on the front thereof and a number 2, in accordance with the chart of FIG. 7, marked on the opposite side. Like the kinetic letter dice above, the numbered letter cards are provided as another method of playing various games utilizing the number marking only. As with kinetic letter dice a number may represent any one of a number of letters. Also, as with the kinetic letter dice, each vowel, including the Wild Card Vowel (WCV), has a red 1 associated with it. Consonants, and Wild Card Consonants (WCC), have a black number ranging from 2–6.

Numbered letter—playing cards

Like the kinetic card-letter dice described above, it is possible to combine both the numbered playing cards and numbered letter cards into a single set of cards. A combination numbered letter-playing card in shown in FIG. 13. In the figure, the four of spades is shown on the front of playing card 15 with the letter s marked next to the suit symbol. The back of the card 15 has a number 4 marked thereon. These just-described indicia are in accordance with the chart shown in FIG. 8.

Other variations of the preferred embodiments

Many other configurations of the game pieces described herein can be provided. For example, a playing piece can have, instead of a number, playing card suit, or letters as indicia, other symbols or pictures suitable for young children such as geometric shapes or animals.

EXAMPLES OF GAMES

The following games can be played with the various versions of the above-described kinetic die pieces 10:

High Score: opponents, using a predetermined number of kinetic die pieces 10, attempt to obtain the highest score by adding the exposed numbers of their respective sitters.

Straight Ahead: each player attempts to create sitters showing the numbers from 1 to 6.

Sitters: each player attempts to create as many sitters as possible, without regard to the indicia 14.

Poker: as explained earlier, draw poker can be played. Of course, any other poker variation, or any other card game can be played, including, for example, blackjack or gin.

Dice: a standard die is rolled and then each player takes a turn trying to create a sitter matching the rolled die value.

Target: As explained with reference to FIG. 10, an object of a game can be to create a sitter within a certain target zone. Games boards such as chess/checker boards may also be used for this purpose to create, for example, vertical, horizontal or diagonal lines of sitters in at least three adjoining squares.

Cryptograph: using kinetic letter dice, players create and decipher words using only the number indicia 14.

Crossword: players create sitters with letter indicia showing and then attempt to create words in a crossword fashion.

War: a player attempts to create a sitter. Once successful, the opponent player then tries to create a sitter of higher value. If he is successful, the opponent player takes not only the first player's sitter, but also all failed sitters.

Bowling: using only the numbered flattened end, a player continues to "roll" until he fails to create a sitter whereupon the total point values showing on sitters are added together for a score. An opponent then "rolls" his own pieces until he fails to create a sitter. Ten frames or turns can be taken at which point a winner is declared, or the first player to reach 300 is declared the winner.

Football: using scratch paper, a football grid is drawn. Sitters must be created to "advance" a ball on the grid. Four chances or "downs" are permitted to advance the ball 10 yards for a "first down" corresponding to sitters having an added value of 10.

What is claimed is:

1. A method of playing a game comprising the steps of:

providing a game piece having a cylindrical body having a side surface and two flattened ends each having indicia marked thereon, said cylindrical body having a diameter of sufficient size such that said cylinder can stand on one of said flattened ends, and said cylinder being made of a material capable of bouncing off of a hard and flat surface when dropped from a height sufficient such that said game piece can land on one of said flattened end;

holding said game pieces form about 1 to 3 inches above the hard and flat surface;

dropping said playing piece such that said playing piece bounces on the hard and flat surface; and noting, if said playing piece lands on one of said flattened ends, the indicia marked on the other of said flattened ends.

2. The method of claim 1 further comprising:

providing a game board having targets; and determining, after said noting step, whether said playing piece is within one of said targets.

3. The method of claim 2 wherein said game board is a standard chess board having said targets being the squares of the chest board; and an additional target in the squares being that of a circle.

4. The method of claim 1 wherein said playing piece is dropped such that said side surface thereof contacts the hard and flat surface first.

5. The method of claim 1 further comprising the steps of: providing game pieces in which indicia on the ends are numbers; and each player adds the exposed numbers and the player with the highest score wins.

6. A method of playing a game comprising the steps of: providing game pieces in which each game piece has a cylindrical body having a side surface and two flattened ends each having indicia marked thereon, and said cylindrical body having a diameter of sufficient size such that said cylinder can stand on one of said flattened ends;

indicia provided on one of the flattened ends of each game piece which is a card symbol from a standard deck of playing cards such that each piece has one card symbol from a standard deck of fifty-four playing cards which includes two wild cards;

indicia of a red or black number provided on the opposite flattened end of that of the end with the card symbol, the number indicia for the twenty-six heart and diamond playing symbols are red, the number indicia for the twenty-six club or spade playing card symbols are black, the number indicia for game piece having the black wild card symbol is black and the number indicia for the game piece having the red wild card symbol is red, and the numbered indicia for all playing pieces are marked with a number from 1 to 6;

a poker game of five card draw is played in which each player is dealt five game pieces with only the flattened end with the number indicia showing; and as the game is played players narrow down the possibilities of what other players may have in their respective hands by noting the numbered indicia showing for each game piece.

7. A method of playing a game comprising the steps of: providing game pieces in which each game piece has a cylindrical body having a side surface and two flattened ends each having indicia marked thereon, and said cylindrical body having a diameter of sufficient size such that said cylinder can stand on one of said flattened;

indicia on one of the ends is one of the twenty-six letters of the English alphabet or a wild card symbol;

indicia of a red or black number provided on the opposite flattened end of that of the end with the letter or wild card symbol, the numbered indicia for all playing pieces shall be marked with a number from 1 to 6, indicia on one end designated a vowel are marked with a red number 1 indicia on the opposite end, indicia on one end designated a consonant are marked with a black number 2,3,4,5, or 6 indicia on the opposite end, red wild card indicia on one end are designated with a red number 1 indicia on the opposite end and can be used as a substitute for any vowel, black wild card indicia on one end are designated with a black number of either 2,3,4,5, or 6 indicia on the opposite end and can be used as a substitute for any consonant; and one player forms a word using the game pieces while exposing only the numbered end of the piece, a standard die is rolled by an opponent and the kinetic die corresponding to the roll of the standard die is turned over to help the opponent decipher the word.

* * * * *